United States Patent [19]

Sato et al.

[11] Patent Number: 4,726,473

[45] Date of Patent: Feb. 23, 1988

[54] WRAPPER WITH A PERFORATION LINE FOR TEARING

[75] Inventors: Norikazu Sato; Yoshiyuki Kudo, both of Kanagawa, Japan

[73] Assignee: Fuji Photo Film Co., Ltd., Kanagawa, Japan

[21] Appl. No.: 880,439

[22] Filed: Jun. 30, 1986

[30] Foreign Application Priority Data

Jul. 19, 1985 [JP] Japan ..... 60-109733[U]

[51] Int. Cl.[4] ..... B65D 3/26

[52] U.S. Cl. ..... 206/606; 206/634; 206/615; 229/87 R

[58] Field of Search ..... 206/634, 601, 604, 605, 206/606, 608, 609, 611, 612, 615, 623, 627, 432, 497; 229/87 R, 87 S

[56] References Cited

U.S. PATENT DOCUMENTS

| | | | |
|---|---|---|---|
| 2,330,691 | 9/1943 | Darrow | 206/604 |
| 3,001,644 | 9/1961 | Fourness et al. | 206/606 |
| 3,759,378 | 9/1973 | Werth | 206/606 |
| 4,078,659 | 3/1978 | Rensner | 206/497 |
| 4,170,305 | 10/1979 | Hull, Jr. et al. | 206/606 |

*Primary Examiner*—Willis Little

*Attorney, Agent, or Firm*—Sughrue, Mion, Zinn, Macpeak, and Seas

[57] ABSTRACT

A wrapper for enclosing an article. The wrapper is wrapped around the article with an overlapping area of the wrapper being sealed. A line of perforations are aligned in a fixed position relative to the overlapped area so that lateral pressure applied to either side of the perforation line tears the wrapper at the perforations. Preferably, the lower one of the overlapped portions of the wrapper has a cut extending from the side to facilitate separation of wrapper about a tear line.

7 Claims, 17 Drawing Figures

WRAPPER WITH A PERFORATION LINE FOR TEARING

BACKGROUND OF THE INVENTION

1. Field of the Invention

This invention relates to a wrapper to be wrapped around an article.

More particularly, it relates to a wrapper which is removed from the article to be used, such as a wrapper used to be wrapped around one or more cases in which a magnetic tape cassette has been inserted.

2. Background Art

In shipping articles such as magnetic tape cassettes, the articles are covered with wrappers made of wrapping film in order to protect the articles from dust and moisture and to maintain an attractive external appearance. Examples of the wrapping film are transparent of semitransparent cellophane, polyethylene, polypropyrene or polyvinyl chloride films, or those which are coated with polyvinylidene chloride.

Heretofore, in order to facilitate the removal of the wrapper from the article, the wrapper is so designed that a tearing tape is provided inside the wrapping film. That is, when it is required to take the article out of the wrapper, i.e., it is required to remove the wrapper from the article, the tearing tape is pulled to divide the wrapping film into two parts. The two parts of the wrapping film thus formed are easily removed from the article.

A conventional wrapper of this type is as shown in FIG. 1. The wrapping film 3' can be readily divided into two parts by pulling the tearing tape 4'. However, the wrapper is disadvantageous in the following point. In general, the tearing tape 4' is located closer to one end of the article 2 as shown in FIG. 2. Therefore, when the wrapping film is divided into two parts, one of the two parts is larger than the other. Removal of the larger part of the wrapping film from the article is difficult. The degree of difficulty depends on the flatness of the article's shape, the close contact of the wrapper 1' with the article caused when a number of articles are piled one on another in shipping, and the rigidity of the film itself. This tendency is significant in the following case. When the wrapping film of this type is wrapped tight, it is liable to be creased because of its non-uniform thickness (especially the difference in thickness between the printed part and the non-printed part). This difficulty may be eliminated by thermally shrinking the wrapping film, i.e., a heat shrunk wrapper. However, in this case, the previously mentioned difficulty in removing the wrapper becomes more significant.

In order to facilitate the removal of the wrapping film from the article, some of the conventional wrappers provide an instruction to pull the tearing tape obliquely with respect to the article. This will help tearing of the wrapping film two parts, but cannot solve the above-described problem.

SUMMARY OF THE INVENTION

Accordingly, an object of this invention is to eliminate the above-described difficulties accompanying a conventional wrapper.

More specifically, an object of the invention is to provide a wrapper which can be readily removed from the article by tearing the wrapping film.

Yet a further object of the invention is to provide a wrapper which can be supplied at low manufacturing cost by mechanically manufacturing it on the wrapping line.

The foregoing problems have been solved by a wrapper consisting of a wrapping film to be wrapped around an article in which, according to the invention, a series of perforations for tearing the wrapping film are formed in the wrapping film at a predetermined position. The wrapper according to the invention has marks indicating wrapping-film pulling directions in tearing the wrapping film into two parts.

DETAILED DESCRIPTION OF THE PREFERRED EMBODIMENTS

Preferred embodiments of this utility model will be described with reference to the accompanying drawings.

Figure 2:
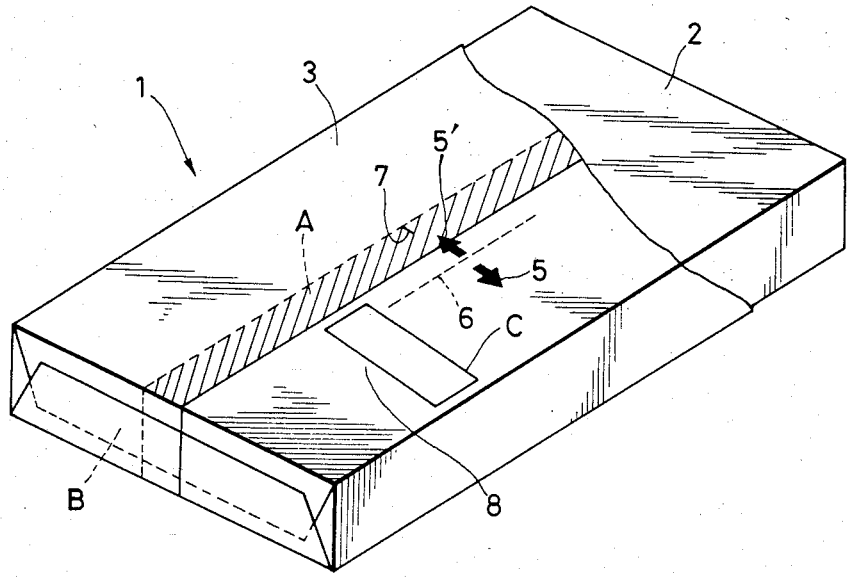
FIG. 2 is a diagram showing one embodiment of this invention.

FIG. 2 shows one example of a wrapper 1 according to the invention which covers a case 2 in which a magnetic tape cassette has been inserted. The wrapper 1 consists of a wrapping film. Examples of the wrapping film are transparent or semitransparent cellophane, polyethylene, polypropyrene or polyvinyl chloride films, or those which are coated with polyvinylidene chloride. The wrapper has the upper and lower portions folded and bonded together, as indicated at B. Also the right and left portions of the wrapper 1, overlap each other, both on the top and ends of the package. The right and left portions are fused together by pressure or heat as indicated at A (indicated by the oblique lines).

In the wrapper 1, a series of perforations 6 (hereinafter referred to as the perforation line 6) are cut, in the form of stitches, near and parallel to the overlap region A in such a manner that the perforation line 6 extends longitudinally of the case 2. Preferably, the perforation line 6 is formed in the right portion of the wrapper 1 which is top-most in the overlap region A. A cut 7 is formed in the lower one of the overlapped right and left portions of the wrapping film substantially at their middle in such a manner that it is located beside the perforation line 6. Arrow marks 5 and 5' indicating wrapping-film tearing directions are printed on the wrapping film on both sides of the perforation line 6, preferably opposite the overlap region A. In addition, an instruction label 8 which describes the method of tearing the wrapping film is also printed on the wrapping film as indicated at C.

Now, the method of tearing the wrapping sheet will be described.

Figure 3:
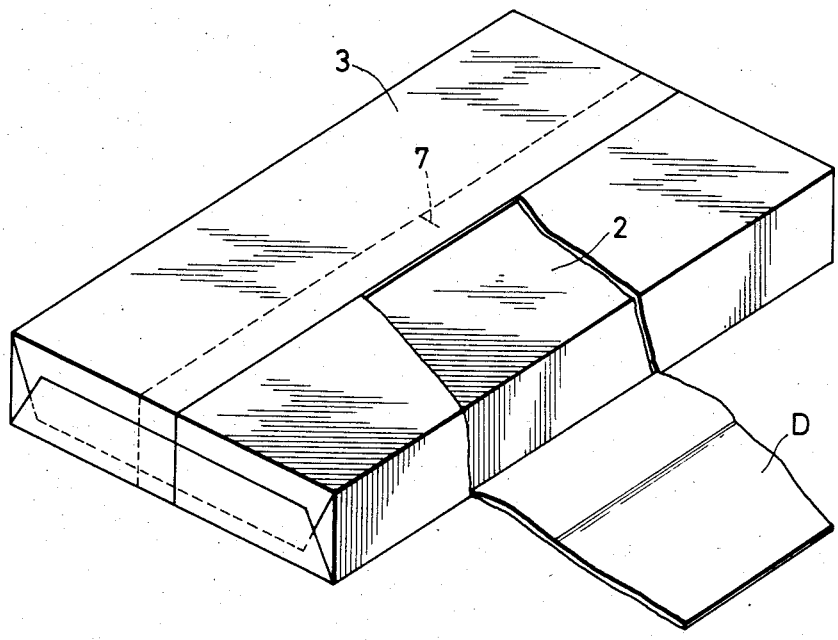
FIGS. 3, 4 and 5 are diagrams showing a method of removing a wrapper of FIG. 2 from the article.
Figure 4:
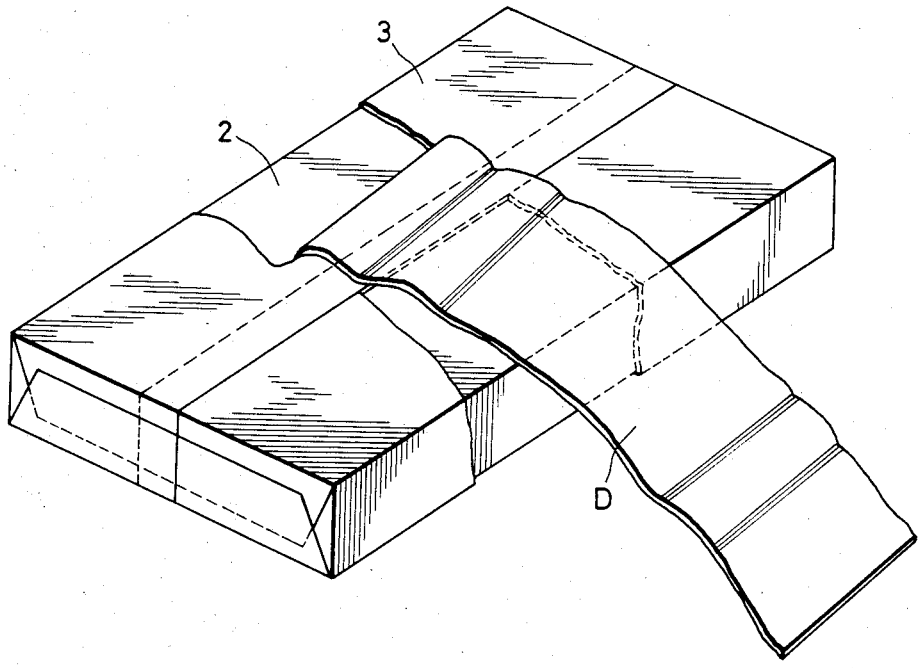

The thumbs of both hands are pushed against the arrow marks 5 and 5', respectively, and moved away from each other (in the direction of the arrows 5 and 5') to tear the wrapping film along the perforation line 6, thereby to form a tearing part D. The tearing part D is pulled outwardly as shown in FIG. 3. The tearing part D thus pulled is further pulled round the case 2 as shown in FIG. 4, as a result of which it can be removed together with the upper one of the overlapped right and left portions of the wrapping film 3.

Figure 5:
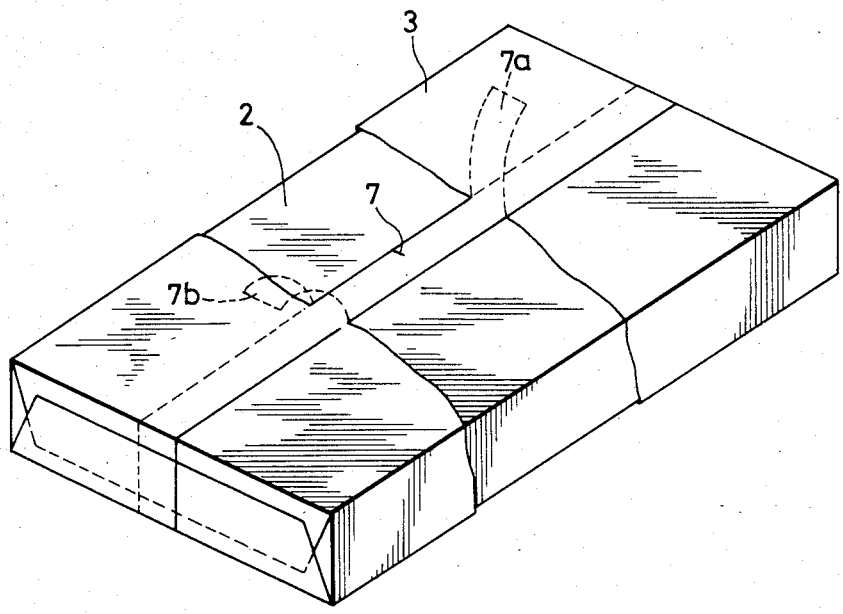

In this operation, the lower one of the overlapped right and left portions of the wrapping film 3 may remain as shown in FIG. 5. Even under this condition, the wrapping film 3 can be satisfactorily removed. However, in order to remove the wrapping film even more readily, the following method is employed. The lower one of the overlapped right and left portions of the wrapping film 3 is cut with the user's finger by utilizing the cut 7, to form two ear pieces 7*a* and 7*b* as indicated by the dotted lines in FIG. 5. The ear pieces 7*a* and 7*b* thus formed are pulled in the opposite directions. As a result, the wrapping film is torn along the overlap region A, or it can be removed from the case as it is. Thus, the wrapping film can be removed, in its entirety, from the case with ease.

Figure 1:
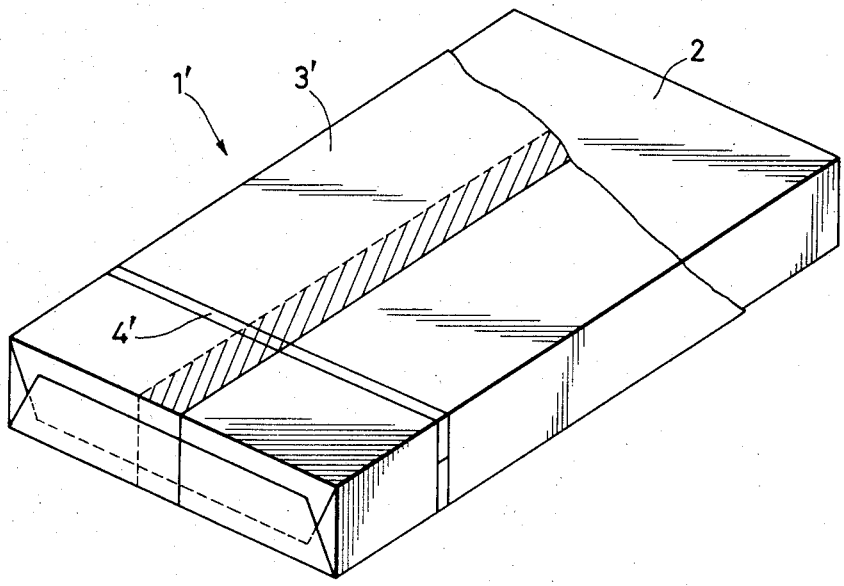
FIG. 1 PRIOR ART
FIG. 1 is a diagram showing a conventional wrapper.
Figure 6A:
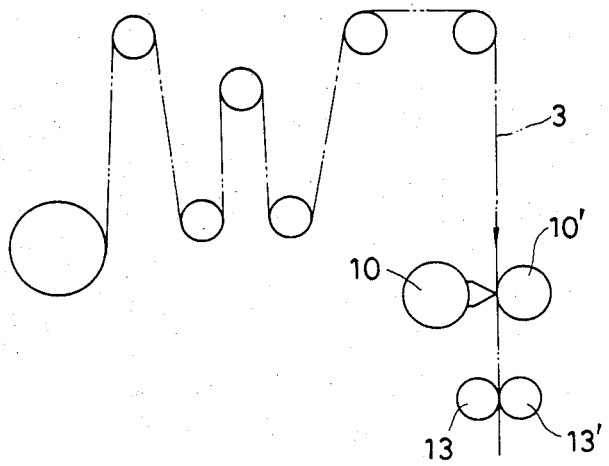
FIGS. 6*a* through 6*d* are diagrams outlining a method of forming the wrapper shown in FIG. 2, an apparatus for practicing the method, and its components.
Figure 6C:
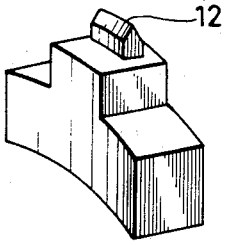
Figure 6B:
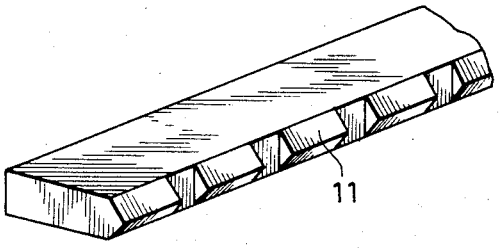
Figure 6D:
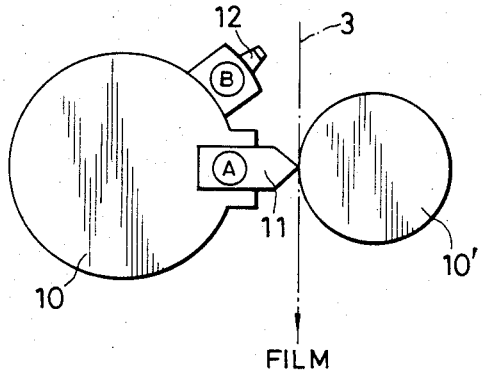
Figure 7:
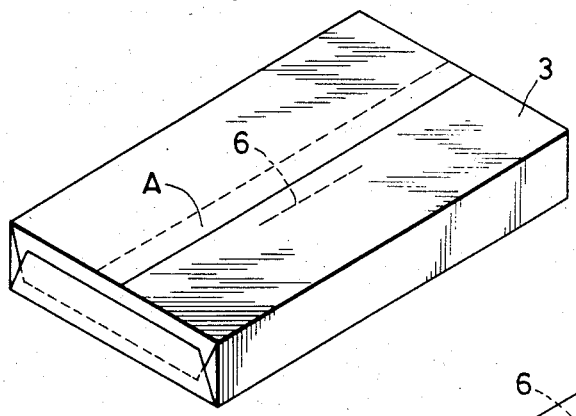
FIGS. 7 through 14 are perspective view showing modifications of the wrapper according to the utility model.
Figure 8:
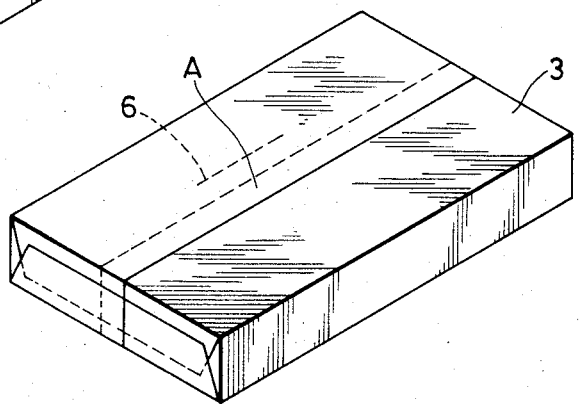
Figure 9:
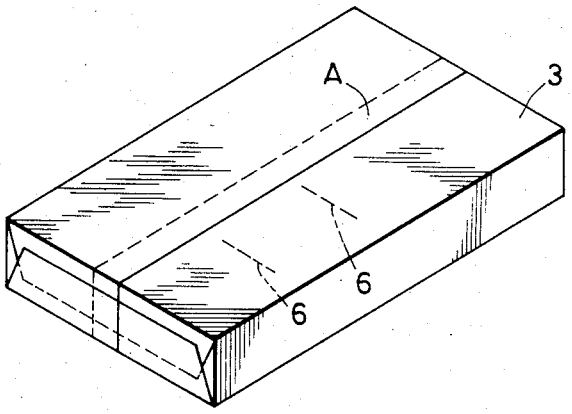

FIG. 6*a* outlines a method of manufacturing the wrapper according to the invention. The wrapping film 3, in the form of a continuous strip, is continuously supplied through a variety of rollers to rollers 10 and 10' to form the perforation 6 and the cut 7. As shown in FIG. 6*d*, the roller 10 has a cutting member 11, shown in FIG. 6*b*, with teeth 11 disposed axially on the roller 10 for forming the perforations 6 and a cutting member 12, shown in FIG. 6*c*, with a tooth disposed circumferentially on the roller 10 for forming the cut 7. These cutting members 11 and 12 are spaced apart from each other along the circumference of the roller 10, as shown in FIG. 6*d*. Therefore, when the wrapping film 3 passes through the rollers 10 and 10', the perforations 6 and the cut 7 are formed in the wrapping film 3 with a predetermined distance therebetween. Thereafter, the wrapping film 3 is conveyed through guide rollers 13 and 13' so that it is wrapped around the article. Under this condition, the right and left portions of the wrapping film 3 are welded together as indicated at A in FIG. 1, and the wrapping film 3 is cut with a predetermined length. Of course, the cutting must be aligned with the perforation line 6 and the cut 7. The upper and lower portions of the wrapping film 3 wrapped around the article are folded, and fused together as indicated at B in FIG. 1.

Figure 10:
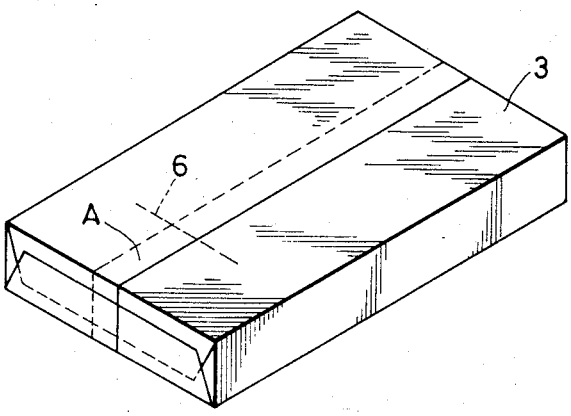
Figure 11:
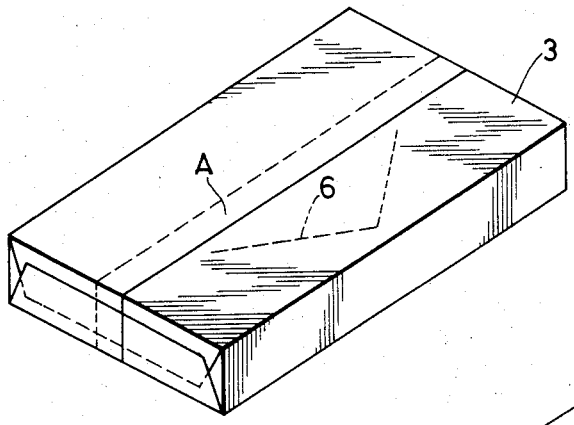
Figure 12:
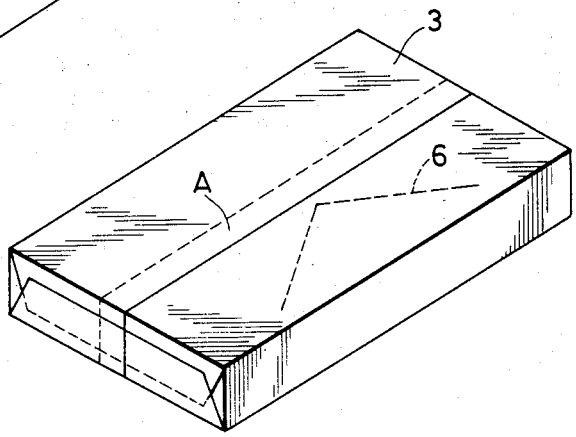
Figure 13:
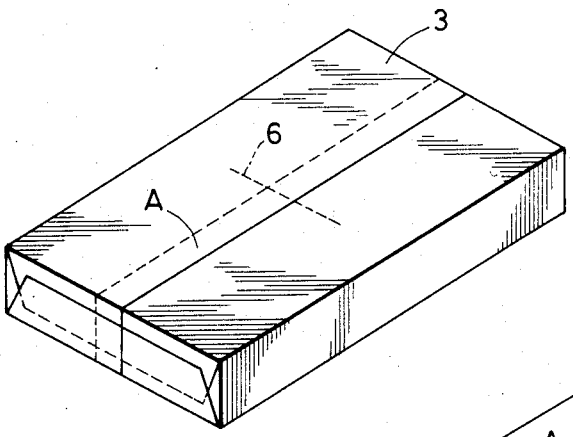
Figure 14:
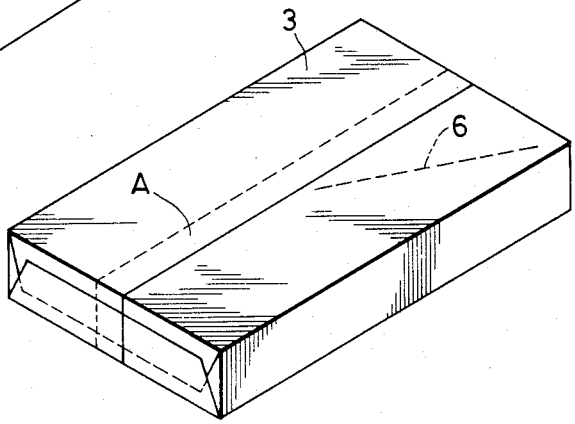

In the above-described embodiment, the perforation line 6 is substantially parallel with the longitudinal direction of the wrapped case 2. However, the invention is not so limited. For instance, the wrapper may be so designed that, as shown in FIGS. 7 through 14, the cut 7 (FIG. 1) is eliminated, the perforation line 6 is perpendicular (FIGS. 9, 10, and 13) or inclined (FIG. 14), a plurality of perforation lines 6 are provided (FIG. 9), or the perforation line 6 is bent (FIGS. 11 and 12). In addition, it goes without saying that the position of the perforation line 6 may be changed as required, e.g., shifted to the upper one of the overlapped portions (FIG. 8) or towards an end (FIG. 10).

According to the invention, no matter how tightly the wrapping film is wrapped around the article, it can be torn wide with the fingers by utilizing the perforations, and therefore it can be readily removed from the article. The wrapper of the invention, unlike the conventional one, needs no tearing tape or the like. In addition, the wrapper of the invention can be formed by mechanical means. Therefore, the wrapper of the invention is much lower in manufacturing cost that the conventional one.

What is claimed is:

1. A wrapper for enclosing an article, comprising:
a wrapping film enclosing an article;
a series of perforations in said wrapping film,
two end portions of the wrapping film overlapping in an overlap area and said series of perforations being located adjacent said overlap area,
wherein said two overlapping end portions of said wrapping film are bonded to each other in said overlap area,
and wherein the inner one of said two overlapping end portions has a cut extending from its end adjacent said series of perforations; such that, said wrapping film may be severed along the line perforations parallel to the overlapping end portions and the wrapping film may be torn about the article at right angles to the wrapping film overlap area, and wherein,
the cut forms two ear pieces at said overlapping end portions to facilitate pulling of respective ear pieces in opposite direction so as to further tear the wrapping film along the overlapping area.

2. A wrapper as recited in claim 1, wherein two end portions of said wrapping film overlap in an overlap area and said series of perforations are located adjacent said overlap area.

3. A wrapper as recited in claim 2, wherein said two overlapped end portions are bonded to each other in said overlap area.

4. A wrapper as recited in claim 2, wherein said series of perforations is a line of perforations parallel to said overlap area.

5. A wrapper as recited in claim 2, wherein the inner one of said two overlapped and portions has a cut extending from its end adjacent said series of perforations.

6. A wrapper as recited in claim 5, wherein said two overlapped end portions are bonded to each other in said overlap area and said series of perforations are a line of perforations parallel to said overlap area.

7. A wrapper as recited in claim 1, further including a pair of arrows on said wrapping film to opposite sides of said series of perforations and pointing away from the series of perforations thereby designating preferred pulling directions to separate said wrapping film along said series of perforations.

* * * * *